US008453854B2

(12) United States Patent
Baran et al.

(10) Patent No.: US 8,453,854 B2
(45) Date of Patent: Jun. 4, 2013

(54) FOLDABLE PRODUCT DISPLAY STRUCTURE

(75) Inventors: Bernardo Herman Baran, Tlalnepantla (MX); Mauricio Herman Dantus, Tlalnepantla (MX); Ruben Arcas, Tlalnepantla (MX); Roman de Jesus Chavez Herrera, Tlalnepantla (MX)

(73) Assignee: Pop Ontime Supply Services, S.A. de C.V. (MX)

( * ) Notice: Subject to any disclaimer, the term of this patent is extended or adjusted under 35 U.S.C. 154(b) by 0 days.

(21) Appl. No.: 13/359,718

(22) Filed: Jan. 27, 2012

(65) Prior Publication Data

US 2013/0062297 A1 Mar. 14, 2013

Related U.S. Application Data

(63) Continuation of application No. PCT/IB2009/007702, filed on Dec. 9, 2009.

(60) Provisional application No. 61/437,772, filed on Jan. 31, 2011.

(51) Int. Cl.

| | |
|---|---|
| ***D06F 57/08*** | (2006.01) |
| ***A47B 43/00*** | (2006.01) |
| ***A47F 5/116*** | (2006.01) |
| ***A47F 5/10*** | (2006.01) |

(52) U.S. Cl.
USPC ..... 211/201; 211/149

(58) Field of Classification Search
USPC ..... 211/72, 149, 186, 195, 201, 202, 211/189, 130.1, 132.1, 182; 108/99–101; 52/633
See application file for complete search history.

(56) References Cited

U.S. PATENT DOCUMENTS

| | | | | |
|---|---|---|---|---|
| 739,085 | A | 9/1903 | Kamerer | |
| 982,477 | A * | 1/1911 | Cavanagh | 211/30 |

(Continued)

FOREIGN PATENT DOCUMENTS

| | | |
|---|---|---|
| DE | 196 23 138 | 12/1997 |
| MX | 18192 | 4/2004 |
| MX | 1434 | 12/2004 |
| MX | PA/a/2005/011459 | 10/2005 |

OTHER PUBLICATIONS

International Search Report mailed Jun. 15, 2010 in corresponding PCT International Application No. PCT/IB09/07702.

(Continued)

*Primary Examiner* — Jennifer E Novosad
(74) *Attorney, Agent, or Firm* — Ostrolenk Faber LLP

(57) ABSTRACT

A display structure has a base with non-rotatable sides and rotatable sides containing a first part with and a second part, the parts fastened by a rotatable fastener; a post containing a first and second face, the two non-rotatable sides fastened to the lower end of the posts, and the rotatable sides fastened to the lower end of the posts, a rotatable fastener specially located so as to allow rotation of the parts in regards to the post; and a top with non-rotatable and rotatable sides, the non-rotatable sides of the top fastened to the top of the post, the rotatable side of the top fastened to the non-rotatable sides of the top with rotatable fastener, said rotatable fastener of the top are specially located to allow rotation of the parts in regards to the non-rotatable side.

15 Claims, 16 Drawing Sheets

U.S. PATENT DOCUMENTS

| | | | | |
|---|---|---|---|---|
| 1,803,742 | A * | 5/1931 | Werme | 211/85 |
| 4,655,354 | A * | 4/1987 | Cohen | 211/199 |
| 4,705,162 | A | 11/1987 | Kupersmit | 206/45.11 |
| 4,986,016 | A | 1/1991 | Wichman | 40/610 |
| 5,131,547 | A * | 7/1992 | Goldberg | 211/149 |
| 5,238,128 | A | 8/1993 | Stoddard | 211/188 |
| 5,251,753 | A | 10/1993 | Pigott et al. | 206/386 |
| 5,555,975 | A | 9/1996 | Smith | 206/762 |
| 5,896,995 | A | 4/1999 | Murray et al. | 206/736 |
| 6,123,207 | A * | 9/2000 | Mast | 211/149 |
| 6,149,021 | A * | 11/2000 | Beaulieu | 211/201 |
| 6,752,281 | B1 | 6/2004 | Mason et al. | 211/195 |
| 7,389,887 | B2 * | 6/2008 | Liang | 211/149 |
| RE41,763 | E * | 9/2010 | Ng | 211/149 |
| 2004/0111999 | A1 * | 6/2004 | Schipani et al. | 52/646 |
| 2005/0055946 | A1 * | 3/2005 | Schipani et al. | 52/633 |
| 2006/0010821 | A1 * | 1/2006 | Schipani et al. | 52/641 |
| 2006/0169660 | A1 * | 8/2006 | Winkler | 211/201 |
| 2007/0000857 | A1 | 1/2007 | Roth | 211/195 |
| 2007/0131633 | A1 | 6/2007 | Ferm | 211/149 |
| 2008/0190872 | A1 | 8/2008 | Scollon et al. | 211/59.4 |
| 2009/0050589 | A1 | 2/2009 | Pedler et al. | 211/85.8 |

OTHER PUBLICATIONS

International Search Report for corresponding International Application No. PCT/IB2012/000121 mailed on Jun. 7, 2012.

* cited by examiner

FOLDABLE PRODUCT DISPLAY STRUCTURE

CROSS-REFERENCE TO RELATED APPLICATIONS

This application is a continuation-in-part of PCT application No. PCT/IB/2009/007702 filed on Dec. 9, 2009. This application claims benefit from provisional application No. 61/437,772 filed on Jan. 31, 2011.

FIELD OF THE INVENTION

The present invention refers to product packaging and display structures, and more specifically to a display which may be assembled and disassembled for the display of products at a point of sale, and even more specifically to product packaging and displays to carry and display products at the point of sale, and an assembly and disassembly method of these displays.

DESCRIPTION OF RELATED ART

The constant population growth demands production of large volumes of products to be purchased. In the points of sale, structures that make it possible to carry a large volume of products in reduced space is required, without missing the primary detail of displaying the product. The distributors of consumable products have problems when setting up a display quickly and completely in the least time possible, and also dealing with the display having the adequate capacity to carry and display the consumable products that are being displayed.

Producers try to solve these problems sending their products packed in a structure that is capable of transporting and displaying the products. While this is useful for certain products, there are other products that have to be set up in situ due to the kind of product or to the producer's preference.

These exhibitors are known in the art. For example, in the US Publication No. 2009/050589, reference is made to a product exhibiting system that can be assembled quickly and provides an efficient display of the product.

In US Publication No. 2008/0190872 an assembly of a modular platform that includes a plurality of pile-up shelves is disclosed, each shelf has a plurality of supports and at least a divider that extends adjacent to the vertical supports, these adjacent vertical supports with space between them so they can receive the product to be displayed. The vertical supports include a plurality of grooves and dividers that include a blocking hook in each opposite extreme, so that each blocking hook hitches a corresponding groove in the adjacent vertical supports, defining so the determined configuration of platform.

In Mexican patent application No. PA/a/2005/011459, a packing structure is disclosed, and it is used for the containment, transportation, display and sale of the products in points of sale, it is a kind of structure consisting of a cubical three-dimensional frame composed of four angular posts in a hexahedron arrangement, which are put together by their upper and lower ends with angular crosspieces, providing thus empty windows in all its faces; these angular posts and crosspieces are made of compressed rigid cardboard and they have two identical arms that define an "L" shape, disposed with their vertex towards the interior of the structure; this structure is placed on a base or a dais. The joint between the angular posts and crosspieces is given through structural angles that include a flat surface with the shape of an octagonal square with a rounded vertex on each side of the square projecting upwards and perpendicularly a fixing flap of a substantially trapezoidal section; these flaps and the flat section with a square shape include holes through which the fixing devices are lodged in order to fix the arms to the crosspieces posts; a rectangular tab is provided exactly at the outer corner of the octagonal square.

US Publication No. 2007/0000857 discloses an adjustable exhibition platform and a method for the manufacture of these platforms.

Mexican utility model No. 1434 discloses a display-packing and self-standing supply display that allows the transportation of the product contained from the manufacturer to the points of sale. The display has angular posts that result in a hexahedron configuration, with a plurality of angular crosspieces that are joined at their ends to the posts by means of fixing devices, generating a plurality of perimetric supports at a same level, at multiple heights and a certain separation space; panels for containing and displaying several products are provided, these panels are superimposed or fixed with different devices on the angular crosspieces that result from the perimetric supports.

U.S. Pat. No. 6,752,281 discloses a display device for goods, such as books and posters. The display device has four structures with rectangular supports. U.S. Pat. No. 5,896,995 discloses a transportation container based on a platform and an exhibition shelf that is capable of sustaining itself and having a square form. U.S. Pat. No. 5,251,753 discloses loading/displaying units that include a number of container trays of products piled vertically supporting dividers upwards that maintain the separation between the product containers. U.S. Pat. No. 4,705,162 discloses package for loading and displaying of goods, as well as the assembly method. U.S. Pat. No. 2,941,772 discloses a support of tray for platform frames. The Mexican industrial design No. 18192 discloses a display with a cubic form and with trays.

None of the previous publications disclose a display that can support the weight of the products that are being displayed, and that can be assembled and disassembled easily and promptly, i.e. in a matter of seconds.

BRIEF SUMMARY OF THE INVENTION

The present invention discloses a foldable display structure for products at a point of sale, which can adopt almost any kind of geometric figure, as long as the display structure contains a base and a top with similar shape to the base. These kind of geometric figures generally are polyhedrons of any kind, like for example: tetrahedrons, pentahedrons, hexahedrons, octahedrons, dodecahedrons, icosahedrons, icosidodecahedrons, rhombic triacontahedrons, pentagonal cupolas and octagonal prisms among others. The exhibitor comprises a base, a top, a height, at least one tray, and at least four faces.

The present invention has two main embodiments.

In both embodiments, the base comprises of a number of sides, each side having a first and second end. At least two sides are fixed in an unfoldable manner with the posts and at least two different sides are foldable.

The height is composed of at least three posts. The posts have two faces. The posts have two ends, a first end fixed to the base and a second end fixed to a top. In a first face of the first end, the post is fixed in an unmovable relation with the base; in a second face of the first end that same post is fixed in a movable relation with the base, more specifically, in a rotatable relationship with said base. All the different posts have this same disposition. The disposition of the rotation permitting means in the rotatable sides is specially placed in regards to the posts.

The top comprises a number of sides, which is the same as the base, the sides comprise a first and a second end. At least one of the sides needs to be in a fixed position in regards to the post, that is, is a non-rotatable side, whereas at least two of the sides of the top are in a rotatable relationship in regards to the post. The rotation of these sides is not divided into parts as is done in the base. The disposition of the rotation permitting fixing means in the rotatable sides is specially placed in regards to the posts.

At least one of the embodiments has between the first and second ends of the posts at least one tray base. The number of tray bases may depend on the height of the posts. The number of tray bases may depend on the number of trays to be set up on the display. The tray base has a determined number of sides and is formed essentially like the base above disclosed. The manner in which the tray base is fastened to the posts is essentially the same as the fastening manners of the base above disclosed.

The shelves or trays have a substantially similar shape as that of the tray bases when the tray bases are in an unfolded position. The tray is preferably made of only one piece of material, which is preferably uniform and smooth. The size of the tray (area) is generally given by the size of the tray base. It is required that the size of the tray is such that it can rest on or nestle on the second faces of the sides of the tray base and it is preferred that the first faces of the sides of the tray base demark the ends of the shelves.

Depending on the shape of the display, the display can have at least three faces. These faces can be substantially hollow or substantially solid. If the faces are substantially solid, one can make use of this substantially solid face to put up advertising on the exhibitor. If the faces are substantially solid, this solidity can be achieved by an element positioned vertically that can be put together to the exterior part of the post. The element can be rigid, semi-rigid or foldable. The element can be coupled with the posts by any existing means of joint. Preferably, a means of permanent joint is not required or recommended, but rather a removable joint, because a subsequent uncoupling will be required between the joint element and the posts.

With the above configurations, the tray may have a substantial size, as well a substantial load and at the same time, being stable and self-standing enough to load the products regardless of the size (area) covered by the tray; further, with the above configurations, the display has as an advantage to be assembled and packed quickly.

Therefore, an object of the present invention is to provide a display that can be substantially big in size compared to other displays and that can support the load of the product in spite of the tray's surface, and at the same time provide a display that can be easily assembled and packed.

Another object of the present invention is to provide a display that can contain a substantially heavy load of products and bear the load of the product despite the surface of the tray, and at the same time that can be easily assembled and packed.

Another object of the invention is to provide a display that is structurally sturdy and at the same time is easy to assemble and pack.

Yet, another object of the present invention is to provide a foldable display for its assembly and use.

A further object of the invention is to provide a display that, when folded, occupies less space than other known display.

Yet a further object of the invention is to provide a foldable packaging and display structure, which may be easily assembled and disassembled.

BRIEF DESCRIPTION OF DRAWINGS

The particular features and advantages of the invention, as well as other objects of the invention, will be apparent in the following description, together with the attached figures, which are:

FIG. 17A shows a conventional perspective view of a detail of FIG. 17.

DETAILED DESCRIPTION OF THE INVENTION

Definitions

Rotatable fastening means. A fastening means known in the art which allows rotation between two or more parts, for example a rivet.

Non-rotatable fastening means. A fastening means known in the art which does not allow rotation between two or more parts, for example a bolt, glue or staple.

The present invention discloses a foldable packaging and display structure for products at a point of sale, which can adopt almost any kind of geometric figure, as long as the display structure contains a base and a top with similar shape to the base. These kind of geometric figures generally are polyhedrons of any kind, like for example: tetrahedrons, pentahedrons, hexahedrons, octahedrons, dodecahedrons, icosahedrons, icosidodecahedrons, rhombic triacontahedrons, pentagonal cupolas and octagonal prisms among others. The exhibitor comprises a base, a top, a height, at least one tray, and at least four faces. The preferred figures are hexahedrons such as cubes or cuboids.

The present invention has two main embodiments.

First Embodiment of the Invention

Figure 1:
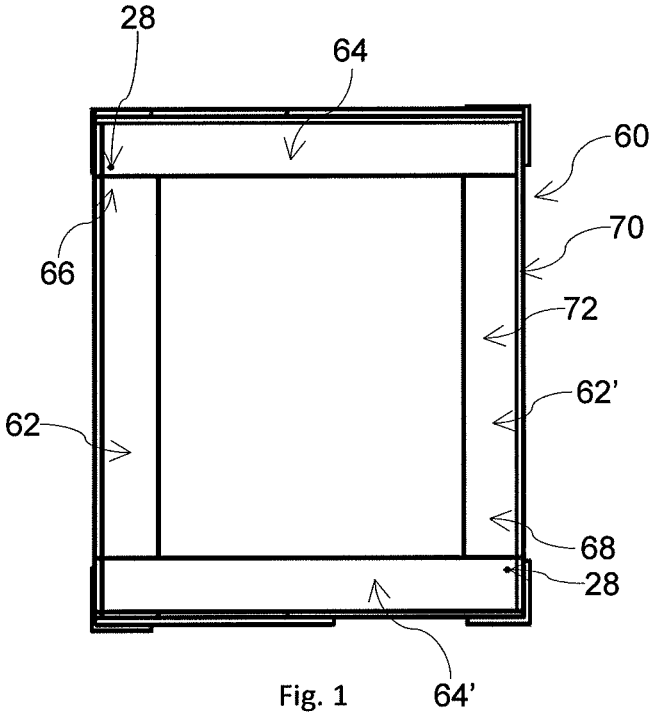
FIG. 1 shows an upper view of the display structure.
Figure 2:
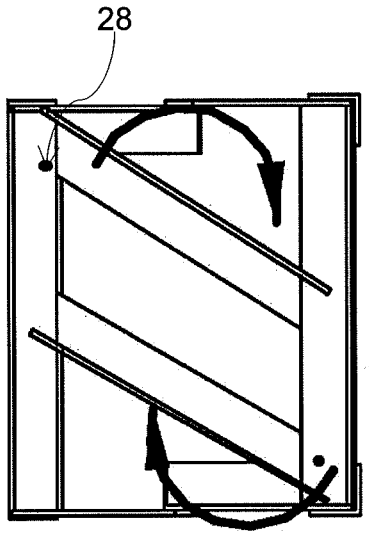
FIG. 2 shows an upper view of the display structure wherein two of the sides of the top are being folded.
Figure 3:
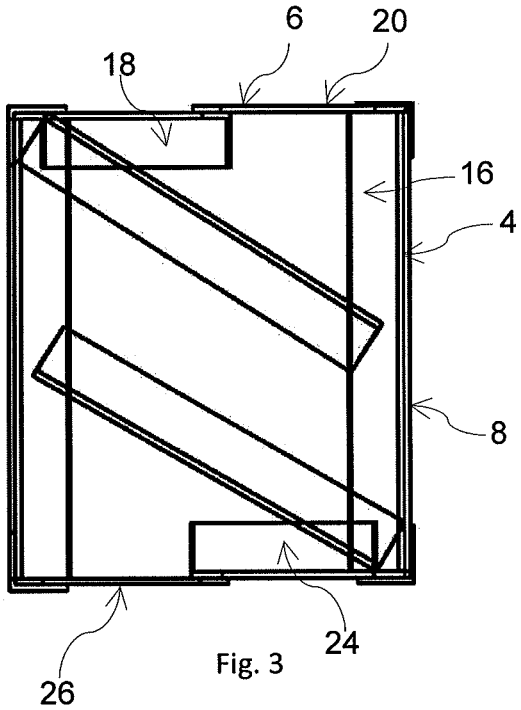
FIG. 3 shows a similar view than FIG. 2, an upper view of the display structure wherein two of the sides of the top are being folded.
Figure 4:
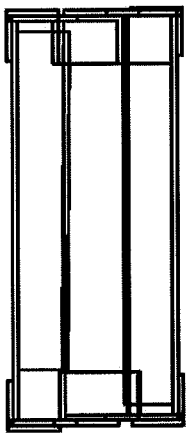
FIG. 4 shows an upper view of the display structure when folded.
Figure 5:
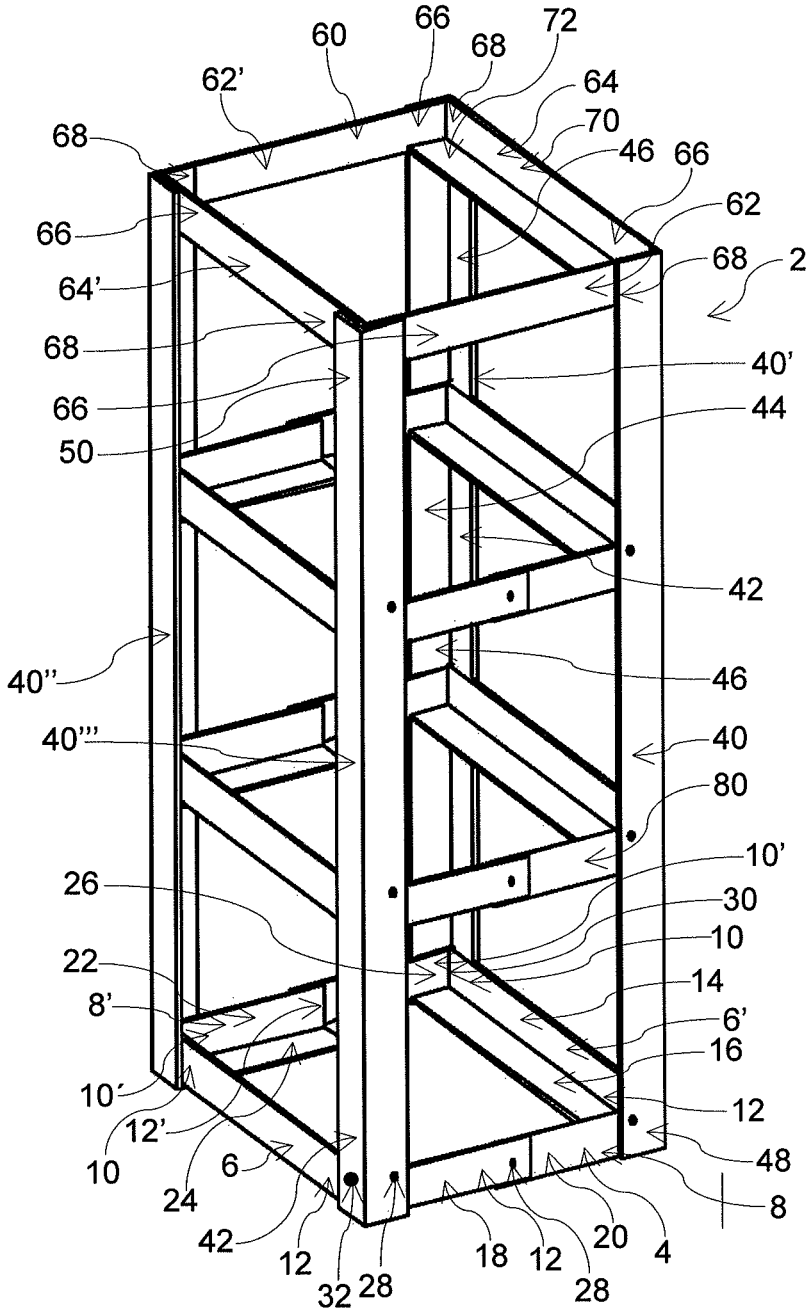
FIG. 5 is a conventional perspective view of the display structure when unfolded.
Figure 6:
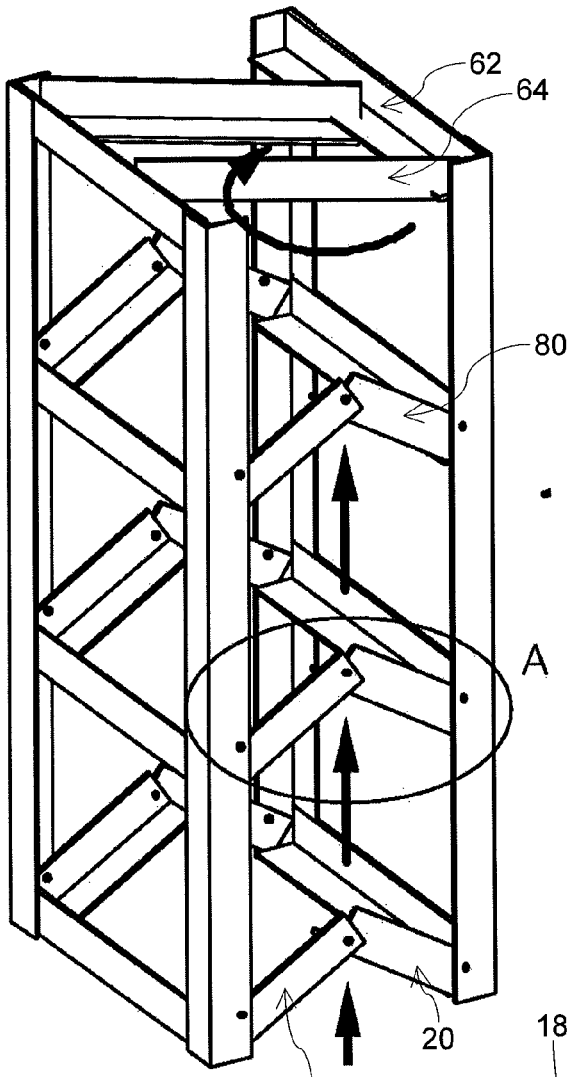
FIG. 6 is a conventional perspective view of the display structure in a first folding step.
Figure 6A:
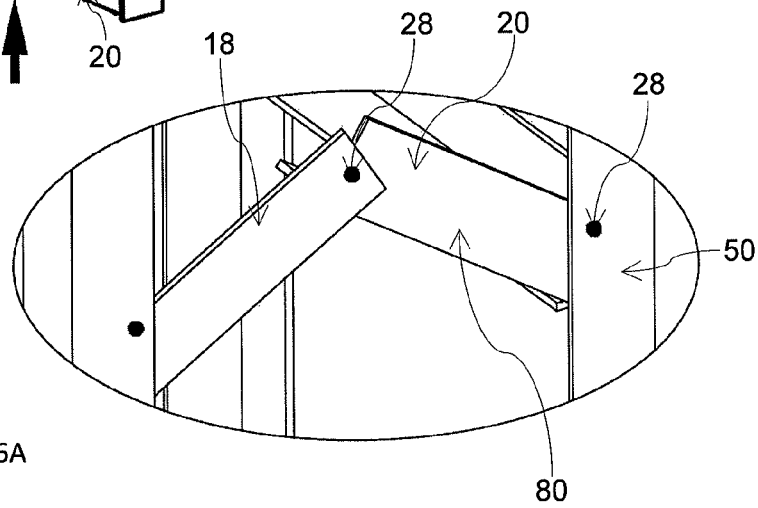
FIG. 6A is a detailed view of A of FIG. 6.
Figure 7:
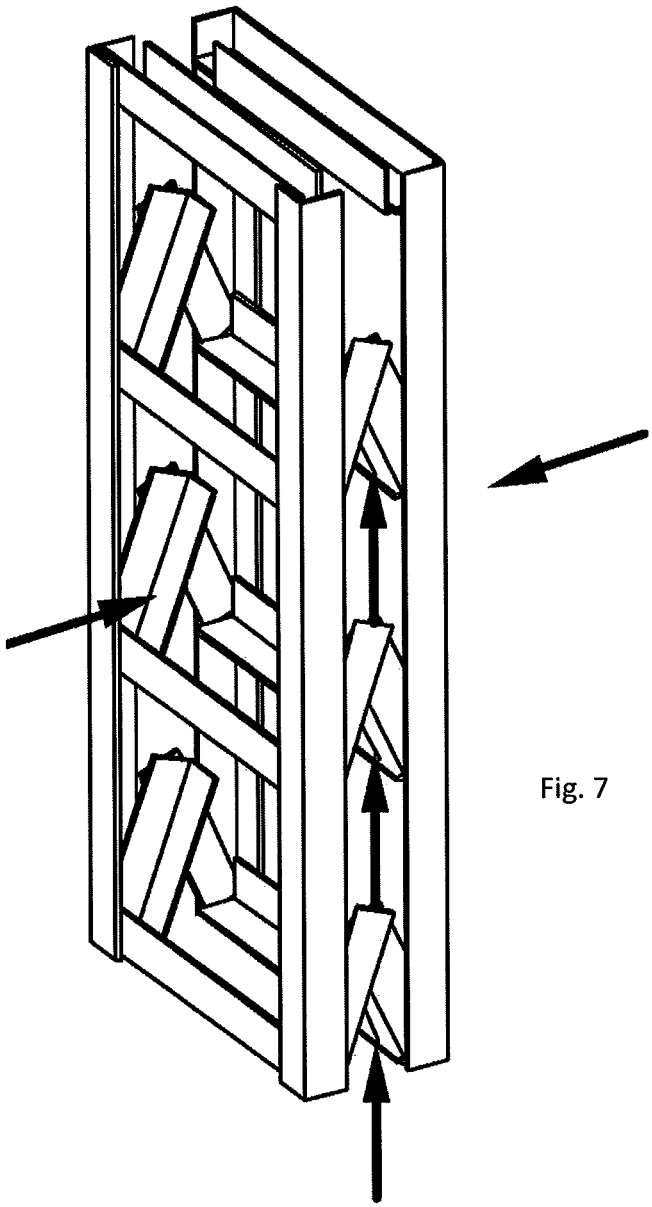
FIG. 7 is a conventional perspective view of the display structure when folded.
Figure 8:
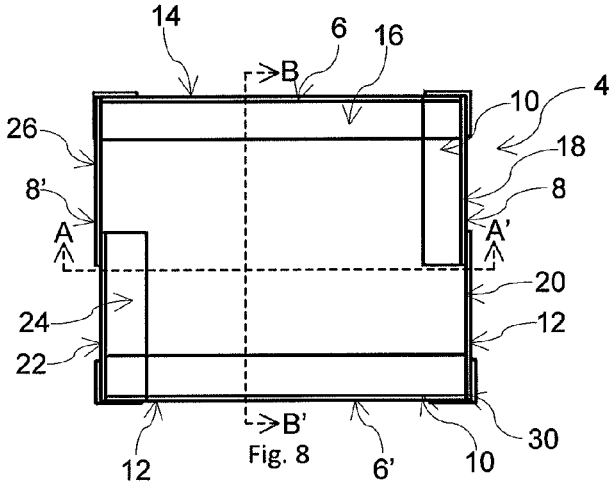
FIG. 8 is an upper view of a base or a tray base.
Figure 9:
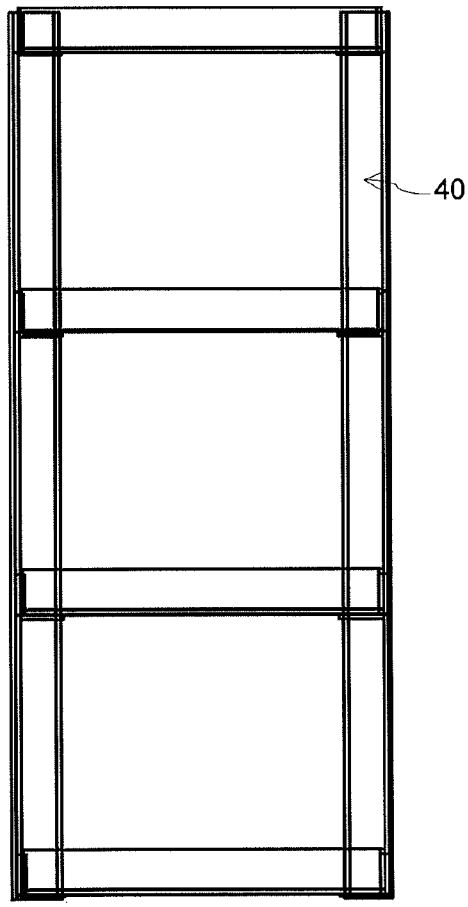
FIG. 9 is a transversal cut view along lines A-A' of FIG. 8.
Figure 10:
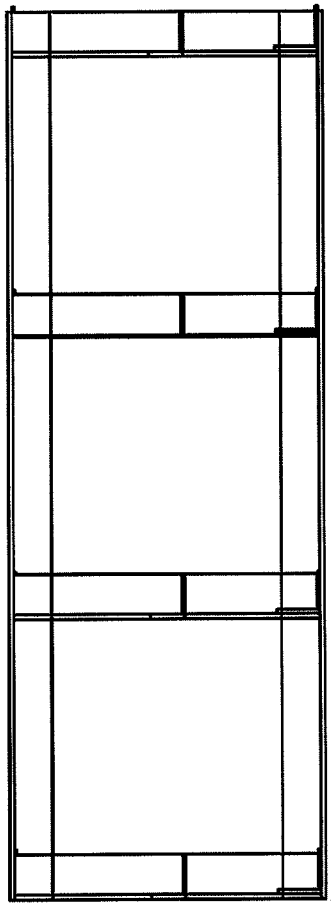
FIG. 10 is a transversal cut view along lines B-B' of FIG. 8.

The following description is made in reference to FIGS. 1-10. A foldable packaging and display structure 2 is shown in the figures. The structure 2 comprises a base 4, posts 40, a top, one or more tray bases 80 and a tray for each tray base. The following exemplary description will be made for a hexahedron, specifically a cuboid or cube, however, the following specification may apply for any configuration.

The base 4 comprises of a number of sides 6, 6', 8, 8', each side having a first 10 and second end 12. At least two sides, a first 6 and a second side 6', of the base 4 are composed of a first face 14 which is located in a substantially vertical plane and a second face 16 being substantially perpendicular to the first face 14, thus the second face 16 being located in a substantially horizontal plane. At least two different sides, for example the third and fourth sides 8, 8', proximate to the first 6 and second 6' sides of the base 4, are divided into two different parts, a first 18 and a second part 20. Both parts 18, 20 have two ends, a first 10' and a second end 12', wherein the first end 10' of either the first 18 or second part 20 is proximate to the first 6 or second side 6'. The first part 18 is formed by a first face 22 which is located in a substantially vertical plane, and by a second face 24 which is located substantially perpendicular to the first face, that is, being in a substantially horizontal position. The second part 20 is formed only by a first face 26 which is located in a substantially vertical position. The first part 18 and the second part 20 are joined by a rotatable fastening means 28, through their first faces 22, 26. The fastening means 28 is fastened proximate to the second end 12' of the parts 18, 20. Furthermore, the fastening means 28 is fastened in a substantially centered part in regards to the height of the first face 22, 26 of both parts 18, 20. If, for example, the display 2 is a hexahedron as above proposed, the first side 6 is separated from the second side 6' by a third 8 and fourth side 8', thus the first 6 and second sides 6' are opposite in regards to the base 4, and the third 8 and fourth sides 8' are opposite in regards to the base 4. The third 8 and fourth 8' sides are mirrored, therefore, the first part 18 of the third side 8 is proximate to the first side 6 and the second part 20 of the third side 8 is proximate to the second side 6', whereas the first part 18 of the fourth side 8' is proximate to the second side 6' and the second part 20 of the fourth side 8' is proximate to the first side 6. The vertex of the two faces 14, 16 and 22, 24 is formed towards the inner part of the display 2; however said vertex may be facing the outer part of the display 2. The number of sides of the base 4 will depend directly on the number of faces contained in the display 2. It is preferred that the number of sides 6, 6', 8, 8' be pair, rather than odd. The vertex between each of the sides 6, 6', 8, 8' provides a corner 30. The vertex between the sides 6, 6', 8, 8' does not need to be an abutting vertex, and may be a proximate vertex, that is, the sides 6, 6', 8, 8' in their corners 30 do not need to be abutting and can simply be proximate. At least two of the sides, that is, the first 6 and second sides 6', of the base 4 are permanently fixed to a column or post 40 in a non-rotable relationship. The fixing means of these two sides 6, 6' to the column or post 40 is a permanent non-rotable fixing means 32. At least two sides, that is, the third 8 and the fourth sides 8' of the base 4, are permanently fixed to the column or post 40 in a rotable relationship. The fixing means of these two sides 8, 8' to the column or post 40 is a rotatable fastening means 28.

The height is composed of at least three posts 40. The number of posts 40 is related to the number of corners 30 that the base 4 has. That is, if the base 4 has three corners 30, then three posts 40 are required; if the base 4 has four or more corners as per the present example, the number of posts required is of at least four posts 40-40'''. The posts 40 consist of two faces 42, 44 on a Z and W plane, considering that the first 14 and second faces 16 of the first 6 and second sides 6' of the base 4 is on a Y and X plane, respectively, where a first face 42 of the post is substantially perpendicular to a second face 44 of the post. Both faces 42, 44 of the posts 40 must have their vertex 46 facing in an inward direction in regards to the display 2. The vertex 46 created between the faces 42, 44 of the posts 40 must be substantially similar to the angle created by the corners 30 of the sides 6, 6', 8, 8' of the base 4, therefore the perpendicularity of the faces 42, 44 of the posts 40 depends on the corners 30 of the base 4. The post 40 is comprised of two ends a first 48 and second end 50. A first end 10 of the first face 14 of the first side 6 of the base 4 is fastened by means of the permanent non-rotatable fixing means to the first face 42 of the first end 48 of a post 40" and a second end 12 of the first face 14 of the first side 6 of the base 4 is fastened by means of the permanent non-rotatable fixing means to the second face 42 of the first end 48 of a post 40'''. A first end 10 of the first face 14 of the second side 6' of the base 4 is fastened by means of the permanent non-rotatable fixing means 32 to the first face 42 of the first end 48 of a post 40' and a second end 12 of the first face 14 of the second side 6' of the base 4 is fastened by means of the permanent non-rotatable fixing means 32 to the first face 42 of the first end 48 of a post 40. The permanent non-rotatable fastener 32 of the first face 14 of the first 6 and second side 6' of the base 4 to the first face 42 of the posts 40-40''' is located in a substantially central part in regards to the intersection formed by the first face 14 of the first 6 and second sides 6' and the first face 42 of the posts 40-40'''. A first end 10' of the first face 22 of the first part 18 of the third side 8 of the base 4 is fastened by means of the rotatable fastening means 28 to the second face 44 of the first end 48 of the post 40 and a second end 12' of the first face 26 of the second part 20 of the third side 8 of the base 4 is fastened by means of the rotatable fastening means 28 to the second face 44 of the of the first end 48 of the post 40'''. A first end 10' of the first face 22 of the first part 18 of the fourth side 8' of the base 4 is fastened by means of the rotatable fastening means 28 to the second face 44 of the first end 48 of the post 40" and a second end 12 of the first face 26 of the second part 20 of the fourth side 8' of the base 4 is fastened by means of the rotatable fastening means 28 to the second face 44 of the of the first end 48 of the post 40'. The rotatable fastener 28 of the first face 22, 26 of the first 18 and second parts 20 of the third 8 and fourth sides 8' of the base 4 attached to the second face 44 of the posts 40-40''' is located in a substantially upper and inner part, that is, near the edge of the second face 44, in regards to the intersection formed by the first face 22, 26 of the third 8 and fourth sides 8' and the second face 44 of the posts 40-40''' and in regards to the inner part of the display 2.

Some of the second ends 50 of the posts 40-40''' is fastened with the top 60 by a permanent non-rotatable fixing means 32.

The top 60 comprises of a number of sides 62, 62', 64, 64', which is the same as the base 4, the sides comprise a first 66, 66' and a second end 68, 68'. At least two of the sides and preferably the four sides, for example a first 62, a second side 62', a third side 64 and fourth side 64' of the top 60, are composed of a first face 70 which is located in a substantially vertical plane and a second face 72 being substantially perpendicular to the first face 70, thus the second face 72 being located in a substantially horizontal plane. The first and second sides 62, 62', which are opposite one to the other, are fixed by a permanent non-rotatable means 32 to the second ends 50 of the posts 40-40'''. Specifically, a first end 66 of the first face 70 of the first side 62 of the top 60 is fastened by means of the permanent non-rotatable fixing means 32 to the first face 42 of the second end 50 of the post 40 and a second end 68 of the first face 70 of the first side 62 of the top 60 is fastened by means of the permanent non-rotatable fixing means 32 to the first face 42 of the second end 50 of the post 40'. A first end 66 of the first face 70 of the second side 62' of the top 60 is fastened by means of the permanent non-rotatable fixing means 32 to the first face 42 of the second end 50 of the post 40'' and a second end 68 of the first face 70 of the second side 62' of the top 60 is fastened by means of the permanent non-rotatable fixing means 32 to the first face 42 of the second end 50 of the post 40'''. The permanent non-rotatable fastener 32 of the first face 70 of the first 62 and second sides 62' of the top 60 to the first face 42 of the posts 40-40''' are located in a substantially central part in regards to the intersection formed by the first face 70 of the first 62 and second sides 62' and the first face 42 of the posts 40-40'''. The third 64 and fourth sides 64' of the top 60, which are opposite one to the other, are fixed by a rotatable means 28 to one of the ends 66, 68 of either the first 62 or second sides 62' of the top 60. Specifically, a first end 66 of the second face 72 of the first side 62 of the top 60 is fastened by means of a rotatable fixing means 28 to the second face 72 of a first end 66' of the third side 64. A second end 68 of the second face 72 of the second side 62' of the top 60 is fastened by means of a rotatable fixing means 28 to the second face 72 of a second end 68 of the fourth side 64'. The rotatable fastener 28 of the second faces 72 of the third 64 and fourth sides 64' of the top 60 to the second face 72 of the first 62 and second sides 62' of the top 60 is located in a substantially inner part in regards to the structure 2.

Therefore, the sides 64, 64' are rotatable in an inwardly orientation in regards to the structure 2, in such a manner that while rotating towards the inner part of the structure 2, the sides 64, 64' meet and at least one side needs to be lifted while the other side needs to be lowered, so that the sides 64, 64' may rest when the structure if folded, over the second face 72 of the non-rotatable sides 62, 62'. As seen in the figures, the foldable sides 64, 64' of the top 60 are co-linear with the foldable sides 8, 8' of the base 4 and tray bases 80.

In between the first 48 and second ends 50 of the posts 40, there is at least one tray base 80. The number of tray bases 80 may depend on the height of the posts 40. The number of tray bases 80 may depend on the number of trays to be set up on the display 2. The tray base 80 has a determined number of sides and is formed essentially like the base 4 above disclosed. The manner in which the tray base 80 is fastened to the posts 40 is essentially the same as the fastening manners of the base 4 above disclosed.

When the sides 64, 64' of the top 60 are folded, that is, resting over the respective faces 72 of the non-rotatable sides 62, 62', the sides 8, 8' of the base 4 and each of the tray bases 80 may be folded. The sides 8, 8' of the base 4 and each of the tray bases are folded, specifically, the intersection between the first part 18 and the second part 20 is folded in a generally upward orientation, so that the first part 18 has the opposite direction to the second part 20 when the structure 2 is folded.

Second Embodiment of the Invention

Figure 11:
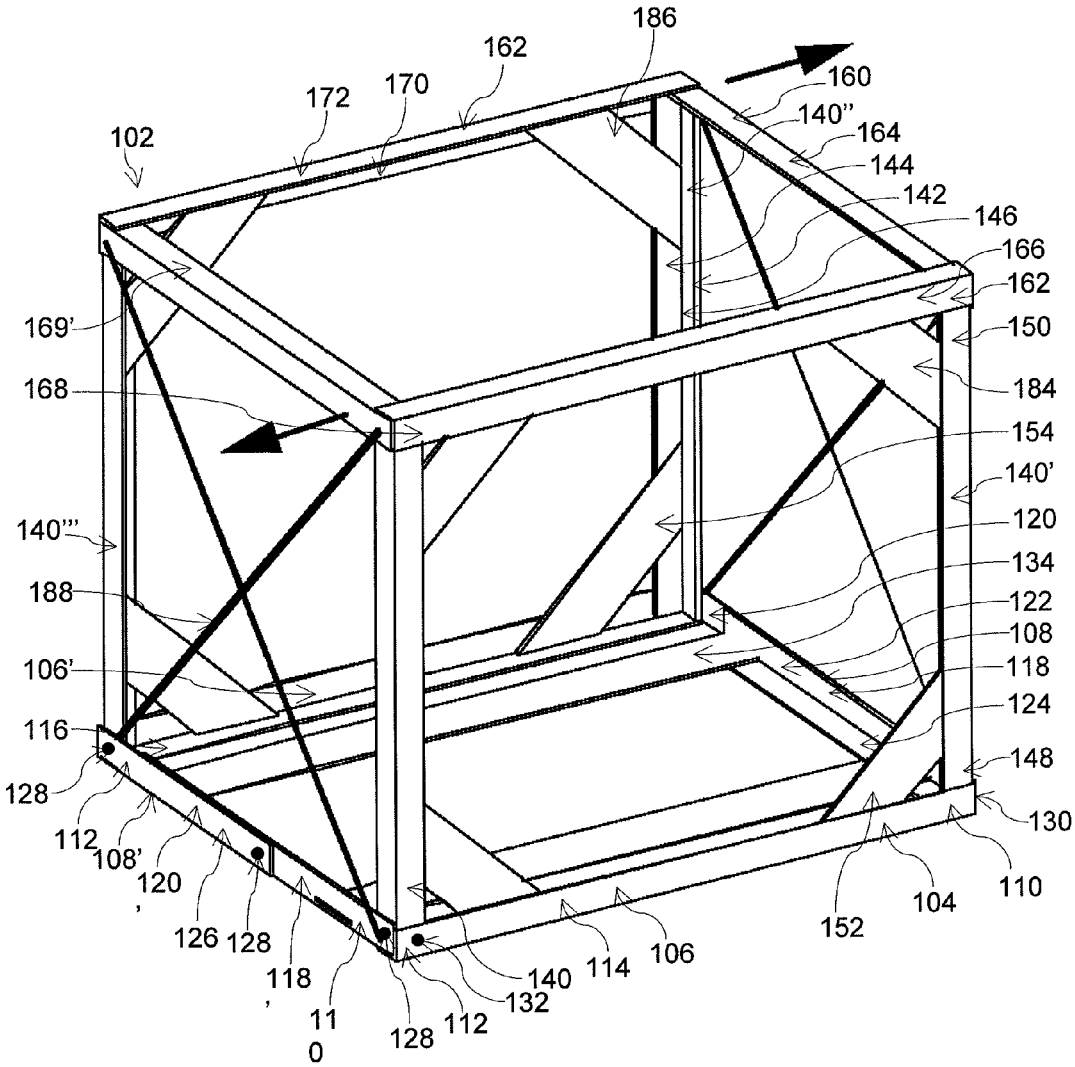
FIG. 11 is a conventional perspective view of an embodiment of the invention, wherein the display is in an unfolded position.
Figure 12:
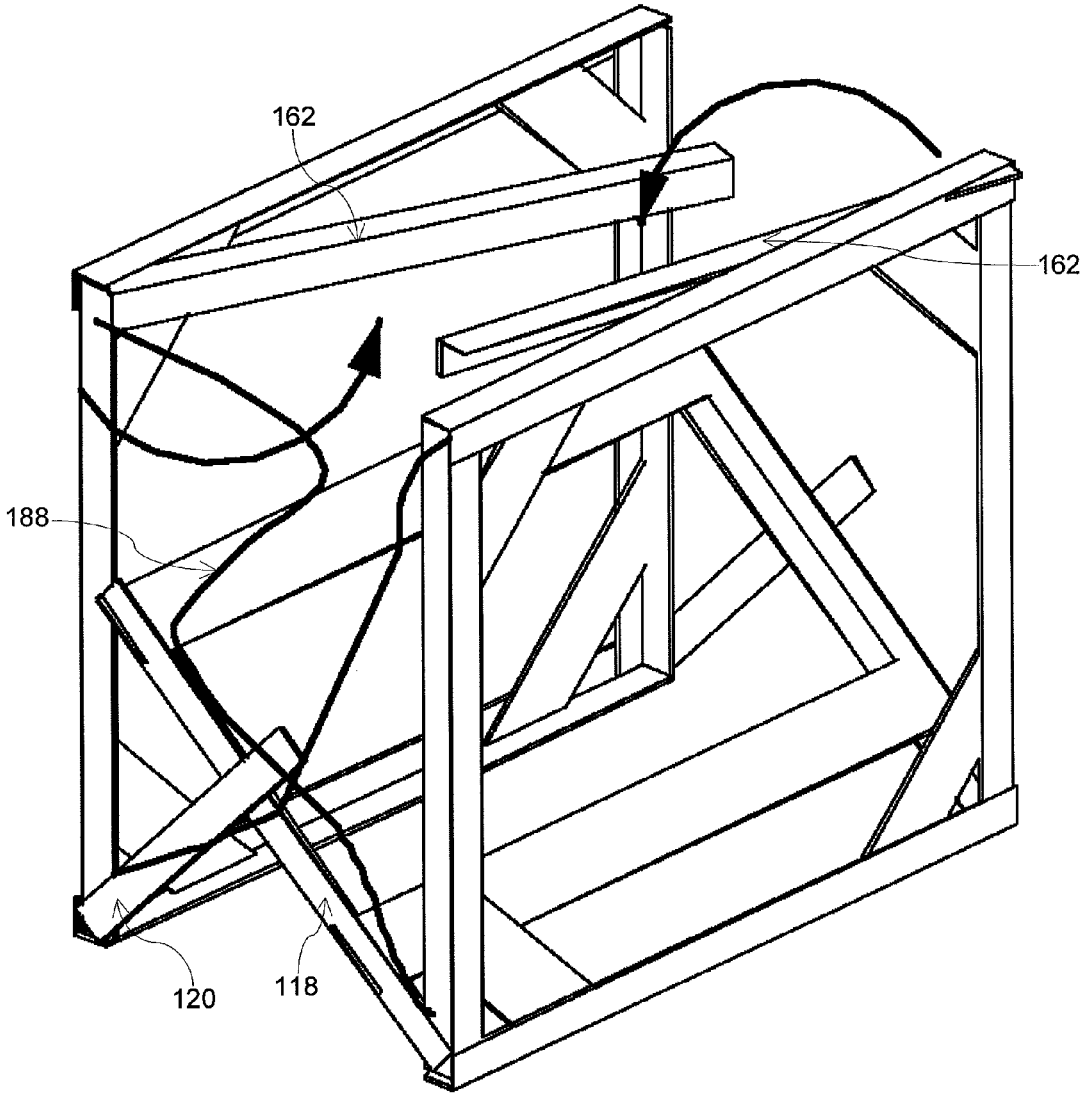
FIG. 12 is a conventional perspective view of the embodiment of FIG. 11, wherein the display is in a semi-folded position.
Figure 13:
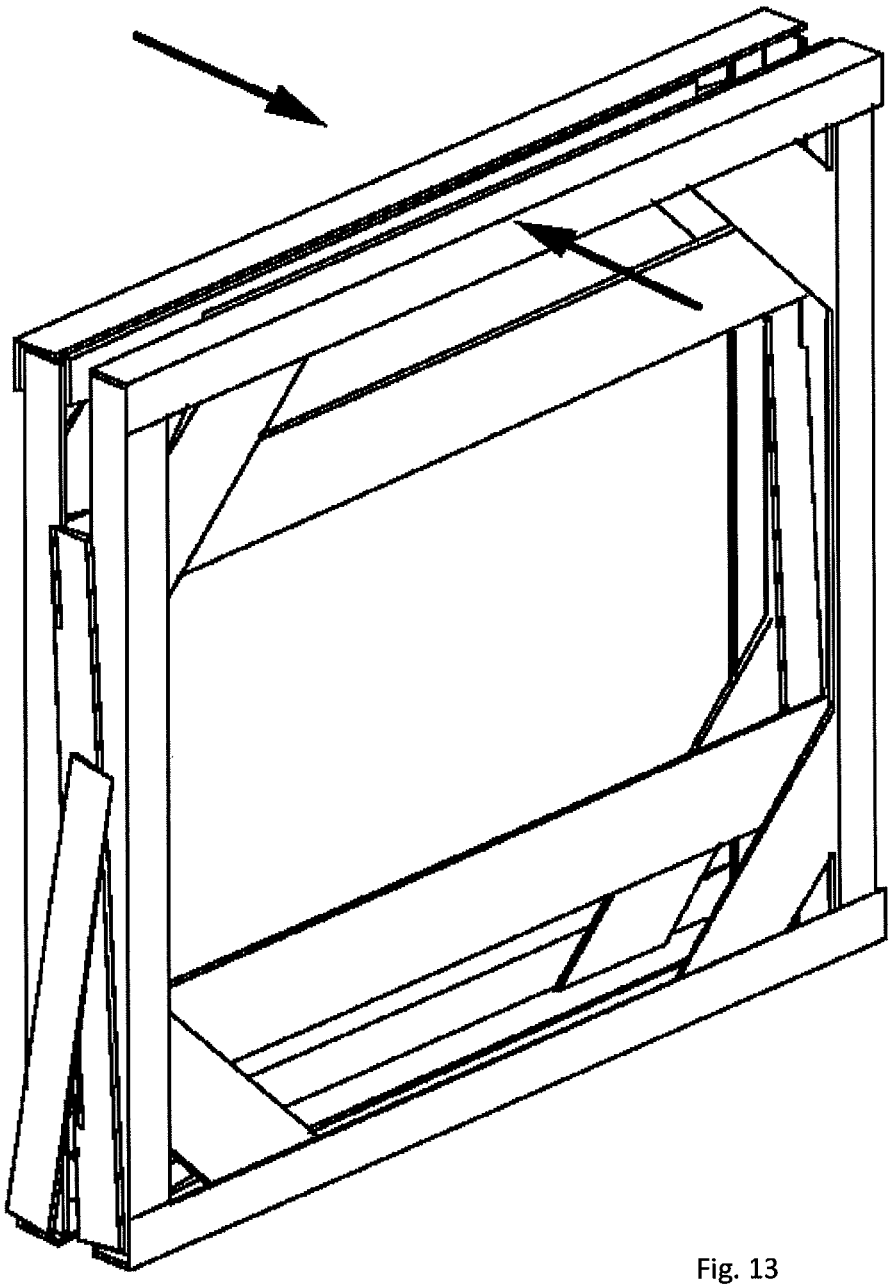
FIG. 13 is a conventional perspective view of the embodiment of FIG. 11, wherein the display is in a folded position.
Figure 14:
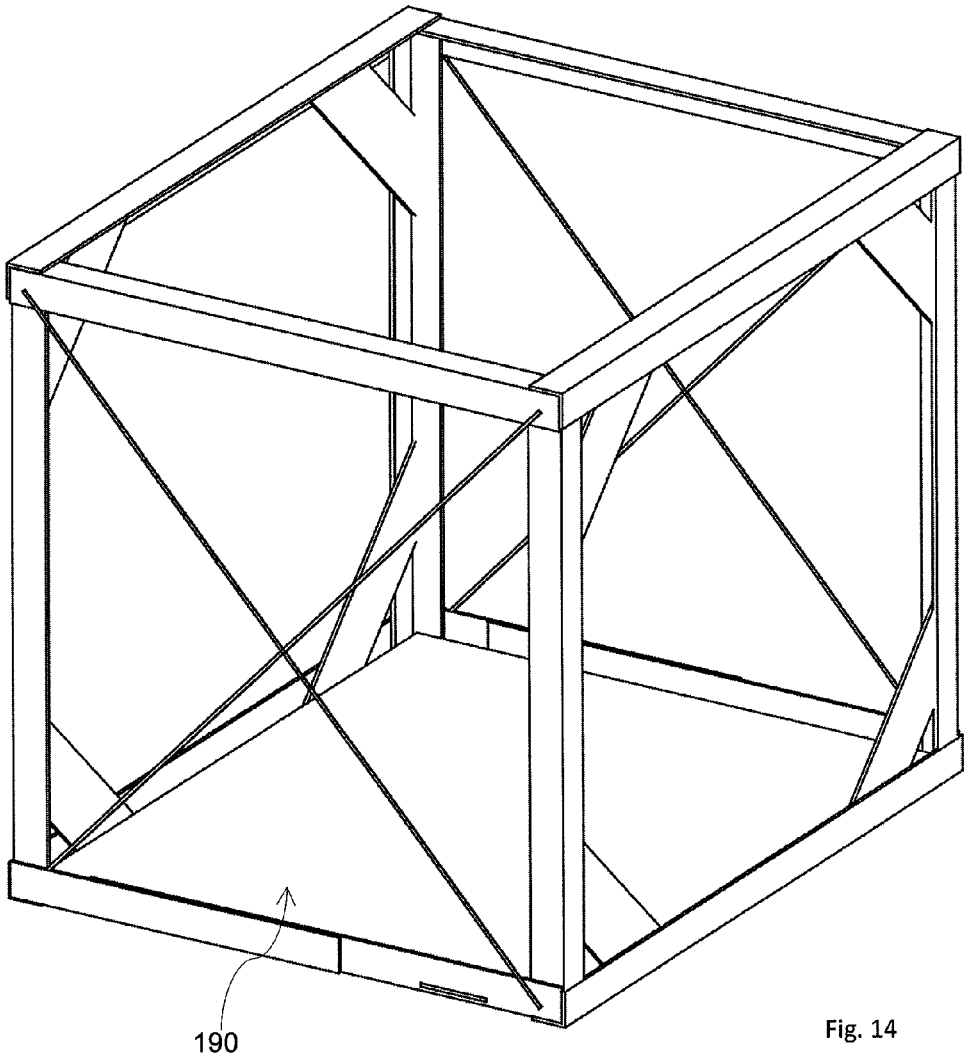
FIG. 14 is a second conventional perspective view of the embodiment of FIG. 11.
Figure 15:
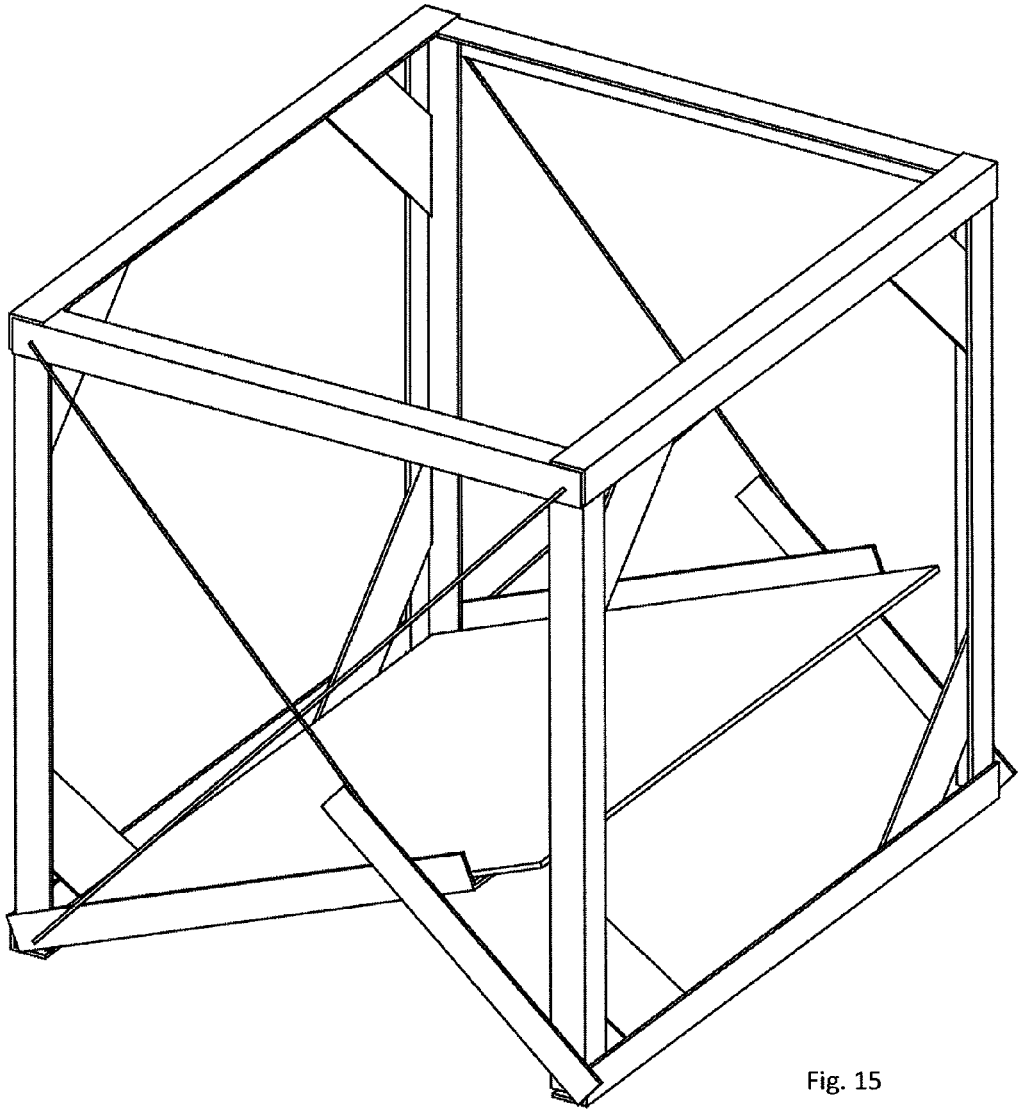
FIG. 15 is a conventional perspective view of FIG. 14, wherein the display is in a semi-folded position.
Figure 16:
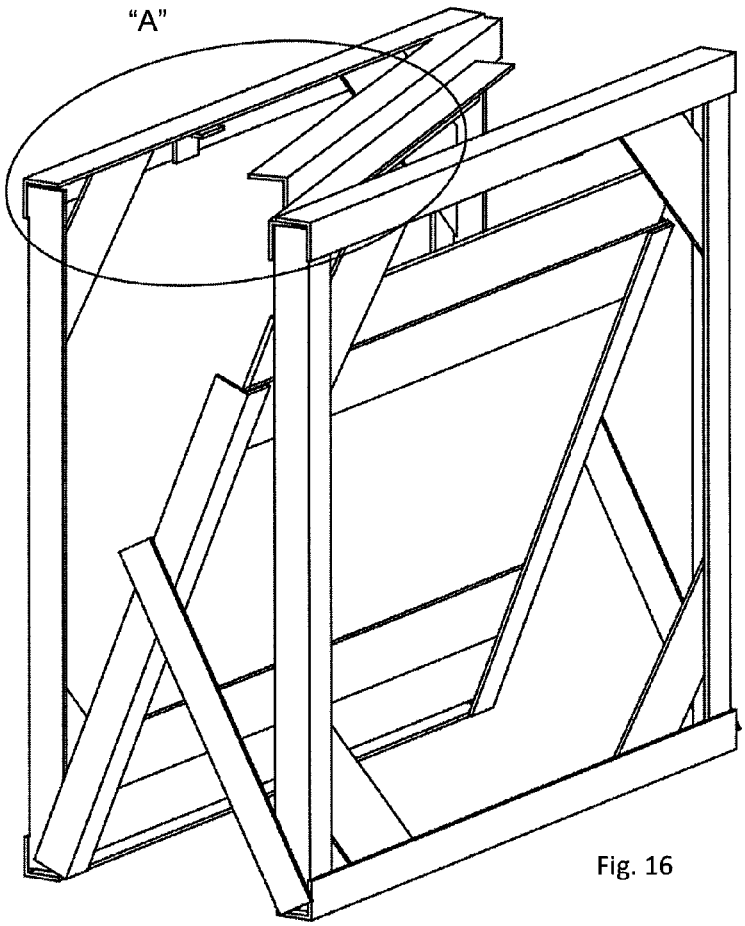
FIG. 16 is a conventional perspective view of FIG. 14 showing how the top is folded.
Figure 16A:
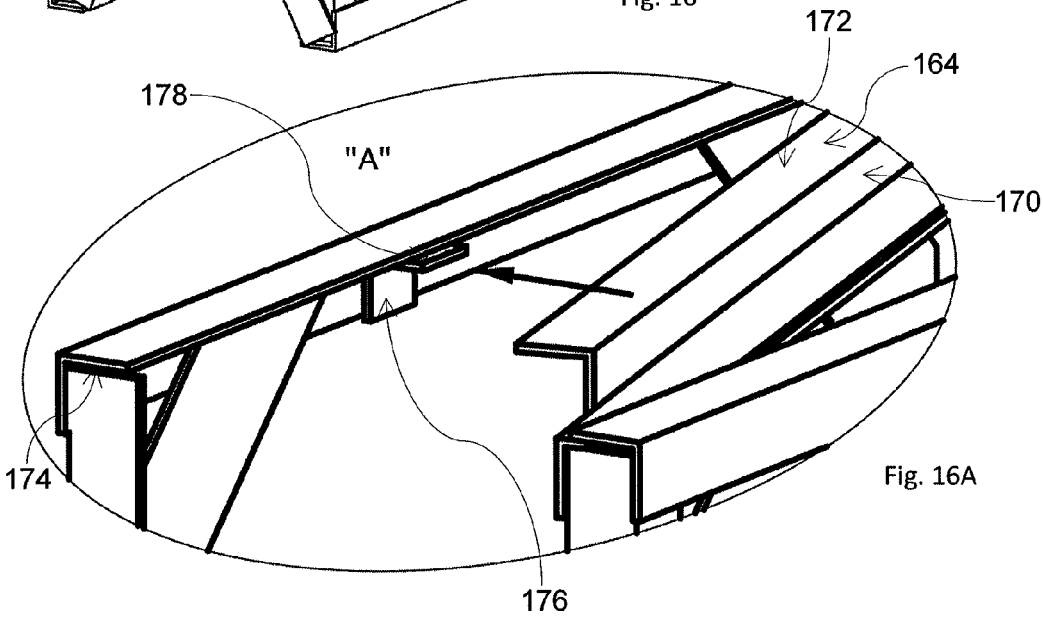
FIG. 16A is a conventional perspective view of a detail of FIG. 16, specifically showing a detail in the top of the display structure.
Figure 17:
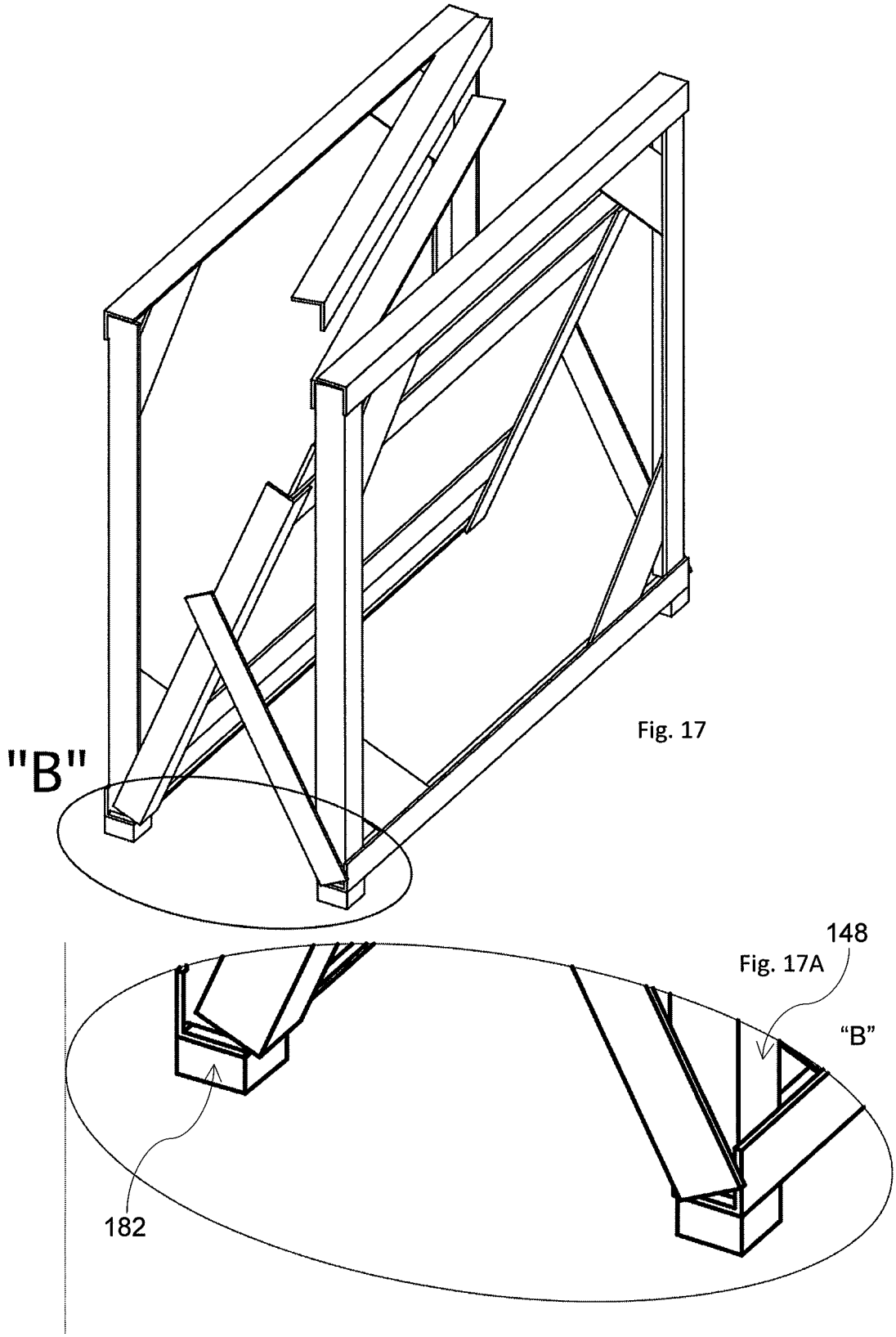
FIG. 17 is a conventional perspective view of FIG. 14 with a specific embodiment.
Figure 18:
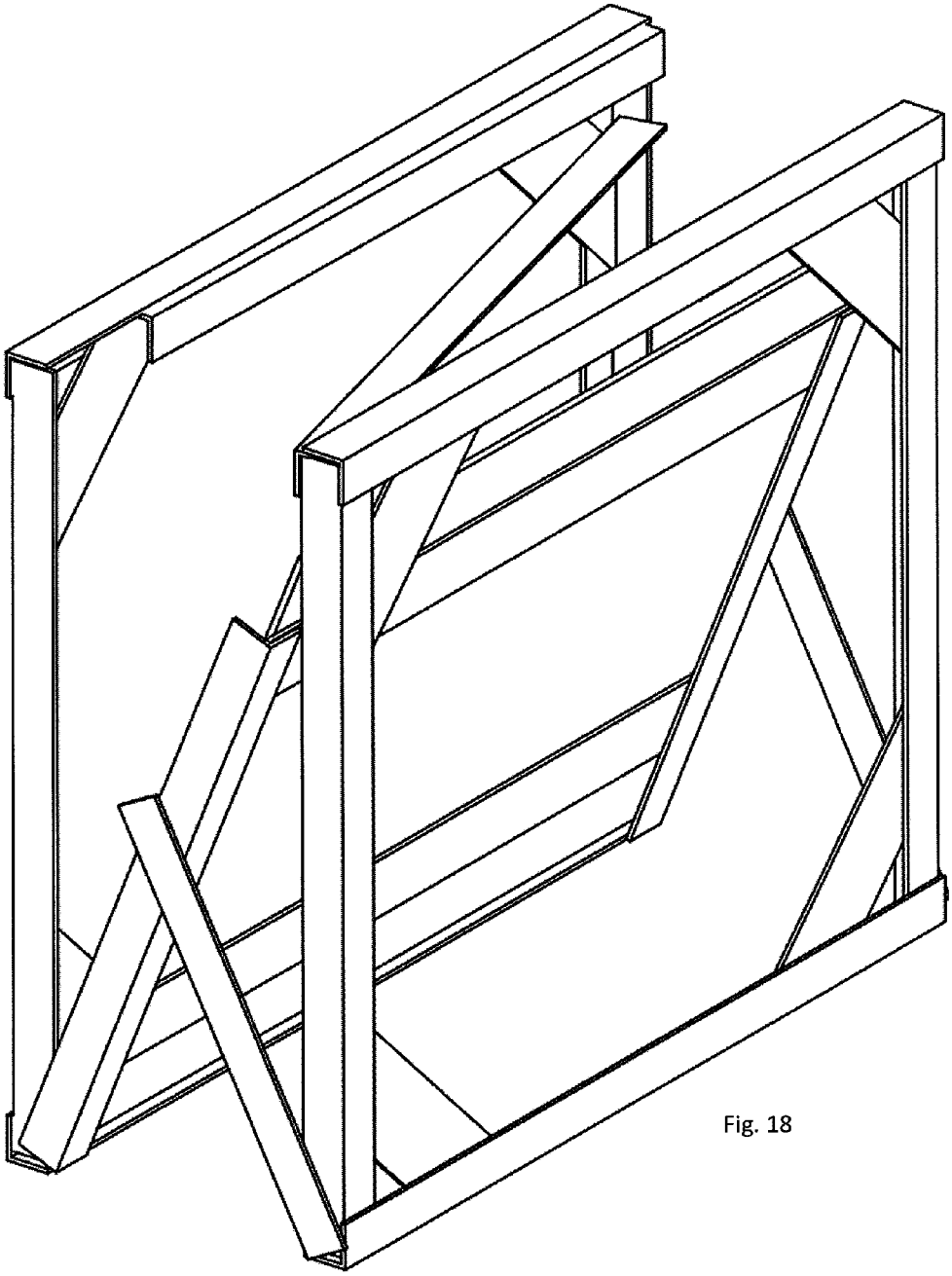
FIG. 18 shows a conventional perspective view of the embodiment of FIG. 11, wherein the display is in a semi-folded position.
Figure 19:
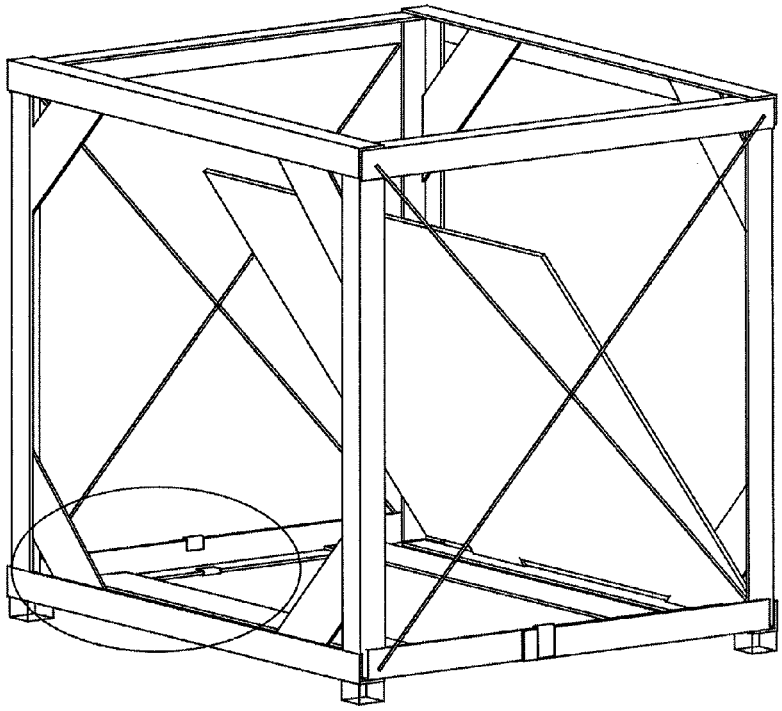
FIG. 19 shows a conventional perspective view of the embodiment of FIG. 11, which a different embodiment.
Figure 19A:
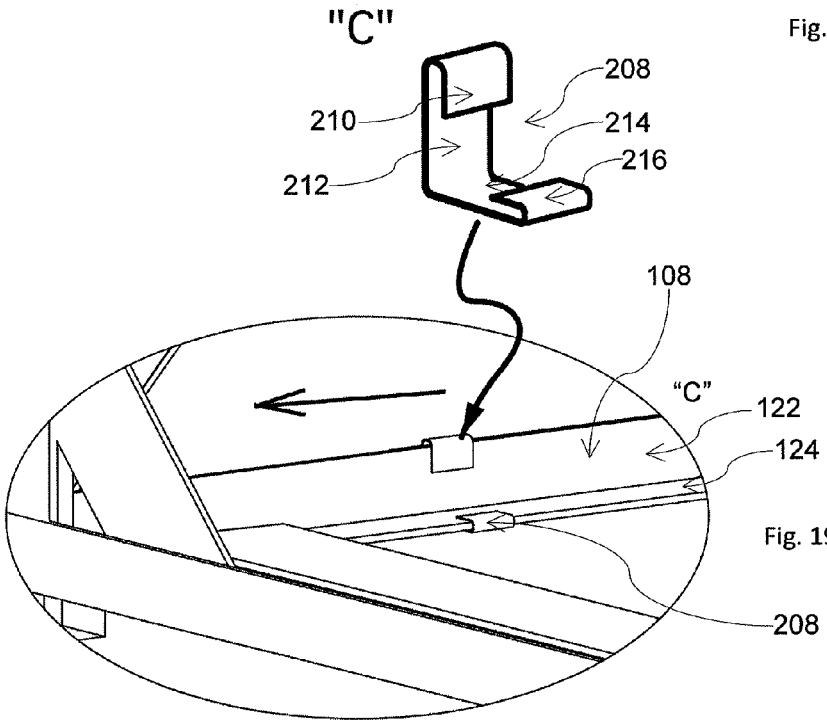
FIG. 19A shows a conventional perspective view of a detail of FIG. 19.
Figure 20:
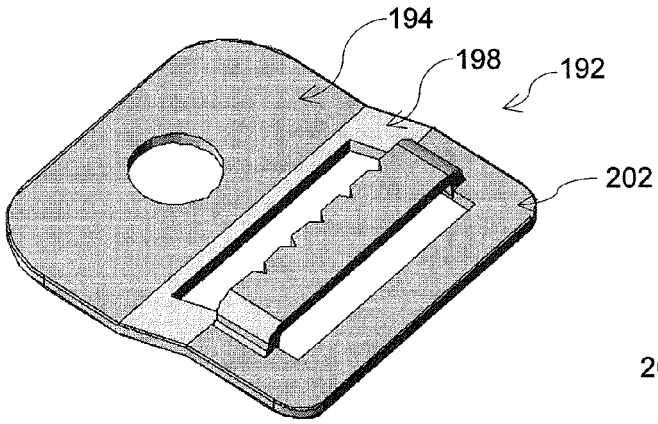
FIG. 20 shows a conventional perspective view of a clip used in the embodiment of FIG. 11.
Figure 21:
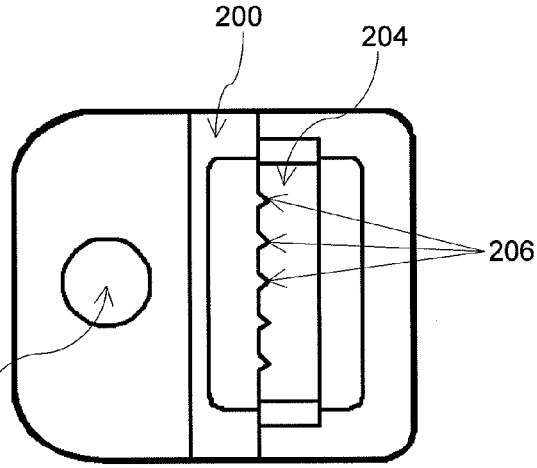
FIG. 21 shows an upper view of the clip.
Figure 22:
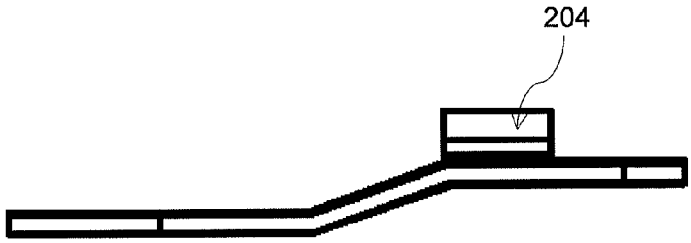
FIG. 22 shows a side view of the clip.

The following description is made in reference to FIGS. 11 through 22. The structure 102 of the second embodiment of the invention is similar to the structure 2 of the first embodiment. Specifically, the structure 102 comprises a base 104, posts 140 and a top 160. As was done for the first embodiment, the preferred representation of the second embodiment is a cuboid or cube however, other shapes may be acquired by the structure; the figures and the following specification will refer to the preferred representation of the second embodiment.

The base 104 comprises of a number of sides 106, 106', 108, 108', each side having a first 110 and second end 112. At least two sides, a first 106 and a second side 106', of the base 104 are composed of a first face 114 which is located in a substantially vertical plane and a second face 116 being substantially perpendicular to the first face 114, thus the second face 116 being located in a substantially horizontal plane. At least two different sides, for example the third and fourth sides 108, 108', proximate to the first 106 and second 106' sides of the base 104, are divided into two different parts, a first 118 and a second part 120. Both parts 118, 120 have two ends, a first 110' and a second end 112', wherein the first end 110' of either the first 118 or second part 120 is proximate to the first 106 or second side 106'. The first part 118 is formed by a first face 122 which is located in a substantially vertical plane, and by a second face 124 which is located substantially perpendicular to the first face, that is, being in a substantially horizontal position. The length of the first part 118, 118' is less than the total length of the side 108, 108', however greater than half the length of the side 108. Specifically, it is preferred that the length of the first part 118 be at least 70% the length of the side 108, more preferably at least 80% and more preferably, at least 85%. The length of the second part 120 is less than the total length of the side 108, 108', however greater than half the length of the side 108. Specifically, it is preferred that the length of the second part 120 be at least 55% the length of the side 108, more preferably between 57% and 65% the length of the side 108. Given the lengths of the first 118 and second parts 120, at least some of the parts 118, 120 overlap between themselves. It is preferred that the second part 120 is in an outwards relation in regards to the first part 118 and the center of the structure 102. The second part 120 is formed only by a first face 126 which is located in a substantially vertical position. The first part 118 and the second part 120 are joined by a rotatable fastening means 128, through their first faces 122, 126. The fastening means 128 is fastened proximate to the second end 112' of the second part 120 and proximate to the middle between the first end 110 and the second end 112 of the first part 118, in such a manner that the fastening means 128 is placed proximate to the middle in regards to the side 108. Furthermore, the fastening means 128 is fastened in a substantially centered part in regards to the height of the first face 122, 126 of both parts 118, 120. If, for example, the display 102 is a hexahedron as above proposed, the first side 106 is separated from the second side 106' by a third 108 and fourth side 108', thus the first 106 and second sides 106' are opposite in regards to the base 104, and the third 108 and fourth sides 108' are opposite in regards to the base 104. The third 108 and fourth 108' sides are mirrored, therefore, the first part 118 of the third side 108 is proximate to the first side 106 and the second part 120 of the third side 108 is proximate to the second side 106', whereas the first part 118 of the fourth side 108' is proximate to the second side 106' and the second part 120 of the fourth side 108' is proximate to the first side 106. The vertex of the two faces 114, 116 and 122, 124 is formed towards the inner part of the display 102; however said vertex may be facing the outer part of the display 102. The number of sides of the base 104 will depend directly on the number of faces contained in the display 102. It is preferred that the number of sides 106, 106', 108, 108' be pair, rather than odd. The vertex between each of the sides 106, 106', 108, 108' provides a corner 130. The vertex between the sides 106, 106', 108, 108' does not need to be an abutting vertex, and may be a proximate vertex, that is, the sides 106, 106', 108, 108' in their corners 130 do not need to be abutting and can simply be proximate. At least two of the sides, that is, the first 106 and second sides 106', of the base 104 are permanently fixed to a column or post 140 in a non-rotable relationship. The fixing means of these two sides 106, 106' to the column or post 140 is a permanent non-rotable fixing means 132. At least two sides, that is, the third 108 and the fourth sides 108' of the base 104, are permanently fixed to the column or post 140 in a rotable relationship. The fixing means of these two sides 108, 108' to the column or post 140 is a rotatable fastening means 128. From the end distant to the rotatable fastening means 128 of the first part 118, to the end distant to the rotatable fastening means 128 of the opposite first part 118' a first connecting bar 134 is provided. Likewise, from proximate to the end proximate to the rotatable fastening means 128 of the first part 118, to proximate to the end proximate to the rotatable fastening means of the opposite first part 118' a second connecting bar 134' is provided. At least one connecting bar 134 may be provided. The connecting bar 134 helps synchronize the folding and unfolding of the first 118, 118' and second parts 120, 120'.

The height is composed of at least three posts 140. The number of posts 140 is related to the number of corners 130 that the base 104 has. That is, if the base 104 has three corners 130, then three posts 140 are required; if the base 104 has four or more corners as per the present example, the number of posts required is of at least four posts 140-140'''. The posts 140 consist of two faces 142, 144 on a Z and W plane, considering that the first 114 and second faces 116 of the first 106 and second sides 106' of the base 104 are on a Y and X plane, respectively, where a first face 142 of the post is substantially perpendicular to a second face 144 of the post. Both faces 142, 144 of the posts 140 must have their vertex 146 facing in an inward direction in regards to the display 102. The vertex 146 created between the faces 142, 144 of the posts 140 must be substantially similar to the angle created by the corners 130 of the sides 106, 106', 108, 108' of the base 104, therefore the perpendicularity of the faces 142, 144 of the posts 140 depends on the corners 130 of the base 104. The post 140 is comprised of two ends a first 148 and second end 150. A first end 110 of the first face 114 of the first side 106 of the base 104 is fastened by means of the permanent non-rotatable fixing means to the first face 142 of the first end 148 of a post 140'' and a second end 112 of the first face 114 of the first side 106 of the base 104 is fastened by means of the permanent non-rotatable fixing means to the second face 42 of the first end 148 of a post 140'''. A first end 110 of the first face 114 of the second side 106' of the base 104 is fastened by means of the permanent non-rotatable fixing means 132 to the first face 142 of the first end 148 of a post 140' and a second end 112 of the first face 114 of the second side 106' of the base 104 is fastened by means of the permanent non-rotatable fixing means 132 to the first face 142 of the first end 148 of a post 140. The permanent non-rotatable fastener 132 of the first face 114 of the first 106 and second side 106' of the base 104 to the first face 142 of the posts 140-140''' is located in a substantially central part in regards to the intersection formed by the first face 114 of the first 106 and second sides 106' and the first face 142 of the posts 140-140'''. A first end 110' of the first face 122 of the first part 118 of the third side 108 of the base 104 is fastened by means of the rotatable fastening means 128 to the second face 144 of the first end 148 of the post 140 and a second end 112' of the first face 126 of the second part 120 of the third side 108 of the base 104 is fastened by means of the rotatable fastening means 128 to the second face 144 of the of the first end 148 of the post 140'''. A first end 110' of the first face 122 of the first part 118 of the fourth side 108' of the base 104 is fastened by means of the rotatable fastening means 128 to the second face 144 of the first end 148 of the post 140'' and a second end 112 of the first face 126 of the second part 120 of the fourth side 108' of the base 104 is fastened by means of the rotatable fastening means 128 to the second face 144 of the of the first end 148 of the post 140'. The rotatable fastener 128 of the first face 122, 126 of the first 118 and second parts 120 of the third 108 and fourth sides 108' of the base 104 attached to the second face 144 of the posts 140-140''' is located in a substantially upper and inner part, that is, near the edge of the second face 144, in regards to the intersection formed by the first face 122, 126 of the third 108 and fourth sides 108' and the second face 144 of the posts 140-140''' and in regards to the inner part of the display 102. Some of the second ends 150 of the posts 140-140''' is fastened with the top 160 by a permanent non-rotatable fixing means 132. From proximate to the first ends 110, 110' of the sides 106, 106' to proximate to the first ends 148, 148' of the post 140, 140' a connecting bar 152, 152' is provided. Likewise, from proximate to the second ends 112, 112' of the sides 106, 106' to proximate to the first ends 148, 148' of the posts 140'', 140''' a connecting bar 154, 154' is provided. At least one connecting bar 152 or 154 may be provided per side 106 and 106'. The connecting bar 152, 154 helps improve the strength of the weight support of the posts 140-140'''.

The top 160 comprises of a number of sides 162, 162', 164, 164', which is the same as the base 104, the sides comprise a first 166, 166' and a second end 168, 168'. At least two of the sides and preferably the four sides, for example a first 162, a second side 162', a third side 164 and fourth side 164' of the top 160, are composed of a first face 170 which is located in a substantially vertical plane and a second face 172 being substantially perpendicular to the first face 170, thus the second face 172 being located in a substantially horizontal plane. The vertex of the two faces 170, 172 is formed towards the inner part of the display 102. The first and second sides 162, 162', which are opposite one to the other, are fixed by a permanent non-rotatable means 132 to the second ends 150 of the posts 140-140'''. Specifically, a first end 166 of the first face 170 of the first side 162 of the top 160 is fastened by means of the permanent non-rotatable fixing means 132 to the first face 142 of the second end 150 of the post 140 and a second end 168 of the first face 170 of the first side 162 of the top 160 is fastened by means of the permanent non-rotatable fixing means 132 to the first face 142 of the second end 150 of the post 140'. A first end 166 of the first face 170 of the second side 162' of the top 160 is fastened by means of the permanent non-rotatable fixing means 132 to the first face 142 of the second end 150 of the post 140'' and a second end 168 of the first face 170 of the second side 162' of the top 160 is fastened by means of the permanent non-rotatable fixing means 132 to the first face 142 of the second end 150 of the post 140'''. The permanent non-rotatable fastener 132 of the first face 170 of the first 162 and second sides 162' of the top 160 to the first face 142 of the posts 140-140''' are located in a substantially central part in regards to the intersection formed by the first face 170 of the first 162 and second sides 162' and the first face 142 of the posts 140-140'''. The third 164 and fourth sides 164' of the top 160, which are opposite one to the other, are fixed by a rotatable means 128 to one of the ends 166, 168 of either the first 162 or second sides 162' of the top 160. Specifically, a first end 166 of the second face 172 of the first side 162 of the top 160 is fastened by means of a rotatable fixing means 128 to the second face 172 of a first end 166' of the third side 164. A second end 168 of the second face 172 of the second side 162' of the top 160 is fastened by means of a rotatable fixing means 128 to the second face 172 of a second end 168 of the fourth side 164'. The rotatable fastener 128 of the second faces 172 of the third 164 and fourth sides 164' of the top 160 to the second face 172 of the first 162 and second sides 162' of the top 160 is located in a substantially inner part in regards to the structure 102.

Therefore, the sides 164, 614' are rotatable in an inwardly orientation in regards to the structure 102, in such a manner that while rotating towards the inner part of the structure 102, the sides 164, 164' meet and at least one side needs to be lifted while the other side needs to be lowered, so that the sides 164, 164' may rest when the structure if folded, over the second face 172 of the non-rotatable sides 162, 162'. As seen in the figures, the foldable sides 164, 164' of the top 160 are co-linear with the foldable sides 108, 108' of the base 104. The upper part of the second end 150 of the post 140 does not abut with the lower part of the second face 172 of the non-rotatable sides 162, 162', thus leaving a gap 174 between said upper part of the second end 150 and the lower part of said second face 172. When unfolded, the end distant to the rotatable fastening means 128 of the sides 164, 164' is embedded within the gap 174 in a tight relationship. That is, when embedded within the gap 174, the side 164, 164', more specifically the end distant to the rotatable fastening means of the side 164, 164', is in an abutting relationship with the first face 170 of the corresponding side 162, so when embedded within said gap 174, the side 164, 164' is non-rotatable. When embedded, to rotate the side 164, 164', the end distant to the rotatable fastening means of the side 164, 164' needs to be pulled in an outwardly direction in regards to the structure 102 and then push inwardly to a folded position. A bracket 176 may be fastened along the inner part of the first face 170 of the sides 162, 162'. A gap 178 is provided between the second face 172 and the bracket 176, so that when in a folded position, the second face 172 of the sides 164, 164' are embedded within said gap 178 and rest over the bracket 176. From proximate to the first ends 166, 166' of the sides 162, 162' to proximate to the second ends 150, 150' of the post 140, 140' a connecting bar 184, 184' is provided. Likewise, from proximate to the second ends 168, 168' of the sides 162, 162' to proximate to the second ends 150, 150' of the posts 140'', 140''' a connecting bar 186, 186' is provided. At least one connecting bar 184 or 186 may be provided per side 162 and 162'. The connecting bar 184, 186 helps improve the strength of the weight support of the posts 140-140'''.

A single tray 190 may be provided over the base 104. Given the length of the first part 118, and given that the first part 118 is in an inner relationship with regards to the second part 120, when the structure 102 is folded, the tray 190 may be kept inside the structure 102 when folded. Therefore, when the structure 102 is unfolded, the tray is already placed within the structure 102.

Stilts 182 may be provided in the first end 148 of the posts, specifically may be positioned in the lower part of the second face 116 and to be co-lineal with the posts 140.

When the sides 164, 164' of the top 160 are folded, that is, resting over the brackets 176 provided in the non-rotatable sides 162, 162', the sides 108, 108' of the base 104 may be folded. The sides 108, 108' of the base 104 are folded, specifically, the intersection between the first part 118 and the second part 120 is folded in a generally upward orientation, so that the first part 118 has the opposite direction to the second part 120 when the structure 102 is folded.

Tensing strips 188 may be used in each of the sides 108, 108', 164, 164'. The tensing strips 188 may be fastened to the ends 110, 112 of the sides 108, 108' of the base 104 and the ends 166, 168 of the sides 164, 164' of the top 160. Alternately, the fastening strips 188 may be fastened to the ends 148, 150 of each of the posts 140-140'''. In any case, the tensing strips 188 need to be crosswise from an upper end to a lower end, crossing the entire length of the side 108, 108', 164, 164' of the structure 102. The tensing strips 188 are fastened to the structure by means of a fastener 192. The fastener 192 consists of three parts 194, 198, 202. The first part 194 contains an opening 196 through which a rotatable fastening means 128 fastens the fastener 192 to the structure 102. The opening 196 is substantially central in regards to the first part 194. The fastener 192 is thus rotatable in regards to the structure 102; furthermore the first part 194 is in an abutting relationship with the structure 102. The second part 198, which is between the first part 194 and the third part 202, is angled in regards to both the first part 194 and the third part 202; such an angling of the second part 198 separates the second 198 and third 202 from the structure 102, so that said second 198 and third 202 parts are no longer in an abutting relationship with the structure 102. Along the second part 198, proximate to the first part 194, an opening 200 is formed. Said opening 200 remains throughout the rest of the second part 198 and includes the third part 202 to a part distant to the second part 198. The third part 202 is substantially parallel to the first part 194. In the third part 202, in the end proximate to the second part 198, a flange 204 is provided. The flange 204 crosses over the opening 200 and has a greater height than the third part 202. In the part which faces the second part 198, said flange 204 contains a plurality of ribs 206. The tensing strips 188 encircle the flange 204 and at least abut the section with ribs 206, the ribs 206 reducing the friction between the tensing strips 188 and the fastener 192. The continuous opening 200 allows the passage of the tensing strips 188, and the correct encircling of the tensing strips 188 without further tensing of said strips, that is, the tensing strips 188 are not in contact with the second part 198 of the fastener 192.

A slideable fastener 208 may be provided to fasten the first part 118 with the second part 120, so that neither of the parts 118, 120 may be rotated when the structure 102 is in an unfolded position. The slideable fastener 208 comprises four parts 210, 212, 214, 216. A first part 210 is designed to be in contact with the inner part of the first face 114; the second part 212 is designed to be in contact with the outer part of the first face 114, therefore, has a substantially different orientation than the first part 210. A third part 214 is substantially perpendicular to the second part 212 in an inwards direction in regards to the structure 102, therefore the third part 214 is designed to be in contact with the lower part of the second face 116. The fourth part 216 is designed to be in contact with the inner part of the second face 116, therefore, has a substantially different orientation that the third part 214 and is therefore substantially perpendicular to the first part 210. The slideable fastener 208 surrounds, at least in part, the first 118 or second part 120 when the structure 102 is in a folded position, or may surround, at least in part, the first 118 and second part 120 when the structure 102 is in an unfolded position.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A foldable display or packaging structure comprising:

a base with at least one rotatable side containing a first part with a substantially vertical face and a substantially horizontal face, and a second part with a substantially vertical face, the first part and the second part fastened by a rotatable fastening means, and at least two non-rotatable sides containing a substantially vertical face and a substantially horizontal face, a vertex between each of the sides forming corners;

a post with lower and upper ends per each corner, the post containing a first face and a second face substantially perpendicular to said first face, a vertex formed by said first face and said second face of the post facing towards the inner part of the structure, the at least two non-rotatable sides fastened to the corresponding lower end of the posts by said substantially vertical face of said at least two non-rotatable sides and said first face of the post, and the at least one rotatable side fastened to the corresponding lower end of the posts with rotatable fastening means by said substantially vertical face of the first and second part of the at least one rotatable side and the second face of the post, the rotatable fastening means located in a substantially upper and inner part of an intersection formed between said substantially vertical face of the first and second parts of the at least one rotatable side and said second face of said posts; and a top with at least one rotatable side containing a substantially horizontal face and at least two non-rotatable sides containing a substantially vertical face and a substantially horizontal face, the at least two non-rotatable sides of the top fastened to the corresponding upper end of the posts by said substantially vertical face of said at least two non-rotatable sides of the top and said first face of the post, the at least one rotatable side of the top fastened by means of its substantially horizontal face to the substantially horizontal face of one of the non-rotatable sides of the top with rotatable fastening means, said rotatable fastening means of the top are located in a substantially inner part of an intersection formed between said substantially horizontal face of the rotatable sides of said top and said substantially horizontal face of the non-rotatable sides of said top.

2. The structure of claim 1, wherein a vertex formed by the two faces of the non-rotatable sides of the top, have a generally outward orientation with regards to a center of the structure.

3. The structure of claim 2, wherein the structure comprises at least one tray base with at least one rotatable side containing a first part with a substantially vertical face and a substantially horizontal face, and a second part with a substantially vertical face, the first part and the second part fastened by a rotatable fastening means, and at least two non-rotatable sides containing a substantially vertical face and a substantially horizontal face, the at least two non-rotatable sides of the tray base fastened to the posts by said substantially vertical face of said at least two non-rotatable sides of the tray base and said first face of the post, and the at least one rotatable side of the tray base fastened to the posts with rotatable fastening means by said substantially vertical face of the first and second part of the at least one rotatable side of the tray base and the second face of the post, the rotatable fastening means located in a substantially upper and inner part of an intersection formed between said substantially vertical face of the first and second parts of the rotatable sides of the tray base and said posts; and a tray per each tray base, the top and the base.

4. The structure of claim 1, wherein at least one first connecting bar is provided from one of the non-rotatable sides of the base to a post and wherein at least one second connecting bar is provided from one of the non-rotatable sides of the top to a post.

5. The structure of claim 1, wherein a vertex formed by the two faces of the non-rotatable sides of the top, has a generally inward orientation with regards to a center of the structure.

6. The structure of claim 5, wherein a gap is formed between an upper part of the upper end of the post and the substantially horizontal face of one of the non-rotatable sides to which the rotatable side is not fastened, the gap being able to house an end distant to the rotatable fastening means of the rotatable side when in an unfolded position; wherein when housed in the gap, the end distant to the rotatable fastening means abuts the substantially vertical face of the non-rotatable side containing the gap.

7. The structure of claim 1, wherein a bracket is fastened along an inner part of the vertical face of the non-rotatable side to which the rotatable side is fastened, a gap being provided between said bracket and the substantially horizontal face of the non-rotatable side to which the rotatable side is fastened, so that when in a folded position, the substantially horizontal face of the rotatable side rests upon said bracket.

8. The structure of claim 1, wherein stilts are provided below the substantially horizontal face of the sides of the base, the stilts being substantially co-lineal with each of the posts.

9. The structure of claim 1, wherein the length of the first part is less than the total length of the rotatable side, and at least 70% of the length of the rotatable side and wherein the length of the second part is greater than half the length of the rotatable side.

10. The structure of claim 9, wherein a slideable fastener is provided in the rotatable side of the base, wherein the slideable fastener comprises a first part which is designed to be in contact with an inner part of the substantially vertical face of the first part of the rotatable side of said base, a second part with an opposite direction to said first part, which is configured to be in contact with an outer part of the substantially vertical face of the first part of the rotatable side of said base, a third part which is substantially perpendicular to the second part and configured to contact with a lower part of the substantially horizontal face of the first part of the rotatable side of said base, and a fourth part which is substantially perpendicular to the to the first part and configured to contact an upper part of the substantially horizontal face of the first part of the rotatable side of the base, wherein the slideable fastener is configured to surround the first and the second part of the rotatable side when the structure is in an unfolded position.

11. The structure of claim 9, wherein crosswise tensing strips are provided per each foldable side, the tensing strips are fastened to the structure by means of a fastener, the fastener comprising a first part, a third part and a second part in between the first part and the third part, the first part containing an opening through which a rotatable fastener fastens said fastener to the structure, the first part designed to be proximate to the structure, the second part is angled in regards to the first part and separates the second and third part from the structure, the second part containing an opening which is shared with the third part, the third part being substantially parallel to the first part and having a flange, proximate to the second part, crossing over the opening shared with the second part and having a greater height than the third part, the flange having a side containing a plurality of ribs.

12. A foldable display or packaging structure comprising:

a base with rotatable sides and non-rotatable sides in between each of the rotatable sides, the rotatable sides containing a first part with a substantially vertical face and a substantially horizontal face and a second part with a substantially vertical face, the first part and the second part fastened by a rotatable fastening means, and said non-rotatable sides containing a substantially vertical face and a substantially horizontal face;

a post with lower and upper ends for each corner formed by the base, each post containing a first and second face substantially perpendicular to said first face, whose vertex is oriented towards the inner part of the structure, the non-rotatable sides fastened to the corresponding lower end of the posts by said substantially vertical face of said non-rotatable sides and said first face of the post, and the rotatable sides fastened to the corresponding lower end of the posts with rotatable fastening means by said substantially vertical face of the first and second part and the second face of the post, the rotatable fastening means located in a substantially upper and inner part of an intersection formed between said substantially vertical face of the first and second parts and said second face of said posts; and a top with rotatable sides containing a substantially horizontal face and non-rotatable sides containing a substantially vertical face and a substantially horizontal face whose vertex has a generally inward orientation with regards to the center of the structure, the non-rotatable sides of the top fastened to the upper end of the posts by said substantially vertical face of said two non-rotatable sides of the top and said first face of the post, the two rotatable sides of the top fastened by means of its substantially horizontal face to the substantially horizontal face of one of the non-rotatable sides of the top with rotatable fastening means, said rotatable fastening means of the top are located in a substantially inner part of an intersection formed between said substantially horizontal face of the rotatable sides of said top and said substantially horizontal face of the non-rotatable sides of said top;

wherein a gap is formed between an upper part of the upper end of the post and the substantially horizontal face of one of the non-rotatable sides to which the rotatable side is not fastened to, the gap being able to house the end distant to the rotatable fastening means of the rotatable side when in an unfolded position; wherein when housed in the gap, the end distant to the rotatable fastening means abuts the substantially vertical face of the non-rotatable side containing the gap;

wherein the length of the first part is greater than half of the length of the rotatable side and wherein the length of the second part is greater than half the length of the rotatable side; and wherein a connecting bar is provided from the substantially horizontal face of the first part of a first rotatable side of the base to the opposite substantially horizontal face of the first part of the second rotatable side of the base.

13. The structure of claim 12, wherein brackets are fastened along an inner part of the vertical face of the non-rotatable sides, a gap being provided between said bracket and the substantially horizontal face of the non-rotatable sides, so that when in a folded position, the substantially horizontal face of the rotatable sides rests upon said brackets.

14. The structure of claim 12, wherein a slideable fastener is provided in the rotatable side of the base, wherein the slideable fastener comprises a first part which is configured to contact an inner part of the substantially vertical face of the first part of the rotatable side of said base, a second part with an opposite direction to said first part, which is configured to contact an outer part of the substantially vertical face of the first part of the rotatable side of said base, a third part which is substantially perpendicular to the second part and configured to contact a lower part of the substantially horizontal face of the first part of the rotatable side of said base, and a fourth part which is substantially perpendicular to the to the first part and configured to contact an upper part of the substantially horizontal face of the first part of the rotatable side of the base, wherein the slideable fastener surrounds the first and the second part of the rotatable sides when the structure is in an unfolded position.

15. The structure of claim 12, wherein crosswise tensing strips are provided per each foldable side, the tensing strips are fastened to the structure by means of a fastener, the fastener comprising a first part, a third part and a second part in between the first part and the third part, the first part containing an opening through which a rotatable fastener fastens said fastener to the structure, the first part designed to be proximate to the structure, the second part is angled in regards to the first part and separates the second and third part from the structure, the second part containing an opening which is shared with the third part, the third part being substantially parallel to the first part and having a flange, proximate to the second part, crossing over the opening shared with the second part and having a greater height than the third part, the flange having a side containing a plurality of ribs.

* * * * *